US005950428A

United States Patent [19]

Nam et al.

[11] Patent Number: 5,950,428

[45] Date of Patent: Sep. 14, 1999

[54] APPARATUS FOR IMPROVING THE OPERATING CAPABILITY OF A CONSTRUCTION MACHINE DURING A FINE OPERATION MODE AND METHOD FOR THE SAME

[75] Inventors: In Taek Nam, Namyangju; Myung Hoon Song, Changwon; Geon Hwang, Seoul, all of Rep. of Korea

[73] Assignee: Volvo Construction Equipment Korea Co., Ltd., Rep. of Korea

[21] Appl. No.: 08/989,050

[22] Filed: Dec. 11, 1997

[30] Foreign Application Priority Data

May 31, 1997 [KR] Rep. of Korea ..... 97-22605

[51] Int. Cl.[6] ..... F16D 31/02

[52] U.S. Cl. ..... 60/421; 60/429

[58] Field of Search ..... 60/421, 429, 430

[56] References Cited

U.S. PATENT DOCUMENTS 5,029,067 7/1991 Nishida et al. ..... 60/421

5,077,973 1/1992 Suzuki et al. ..... 60/428

*Primary Examiner*—F. Daniel Lopez

*Attorney, Agent, or Firm*—Harness, Dickey & Pierce, P.L.C.

[57] ABSTRACT

Disclosed is an apparatus for increasing the operating capability of a construction machine during a fine operation mode and a method for the same. The apparatus being capable of preventing a merged hydraulic fluid from being supplied into a hydraulic actuator and increasing the pressure of the hydraulic fluid being supplied into the hydraulic actuator during the fine operation mode. The apparatus includes a detector that detects the RPM count of the engine of the construction machine and determines whether the engine is switched into the fine operation mode. A first anti-confluence valve and a second anti-confluence valve prevent a first hydraulic fluid supplied into the first actuator and a second hydraulic fluid supplied into the second actuator from merging while either the first actuator or the second actuator is operating. An anti-confluence relay turns the first anti-confluence valve and the second anti-confluence valve on/off. Finally, a controller turns the anti-confluence relay on/off in accordance with a signal generated by the detector.

4 Claims, 3 Drawing Sheets

APPARATUS FOR IMPROVING THE OPERATING CAPABILITY OF A CONSTRUCTION MACHINE DURING A FINE OPERATION MODE AND METHOD FOR THE SAME

BACKGROUND OF THE INVENTION

1. Field of the Invention

The present invention relates to an apparatus for improving the operating capability of a construction machine during a fine operation mode and a method for the same and, more particularly, to an apparatus capable of preventing a merged hydraulic fluid from being supplied into a hydraulic actuator and capable of increasing the pressure of a hydraulic fluid being supplied into the hydraulic actuator during operation of the construction machine in the fine operation mode.

2. Description of the Prior Art

Generally, a construction machine, such as an excavator, is provided with a first hydraulic pump for operating a boom cylinder and a second hydraulic pump for operating an arm cylinder. The first hydraulic pump and the second hydraulic pump drive the boom cylinder and the arm cylinder using a driving force supplied from an engine of the construction machine, respectively.

When an operator wants to perform a desired work using the construction machine as described above, the operator selects a desired operation mode. Selection of the proper operation mode is typically dependent on the working conditions, such as the load conditions involved in performing the above work. In other words, when the operator does not wish to perform an operation, the operator chooses an idle mode as the rotation mode of the engine. In the idle mode, all of the hydraulic fluid is bypassed to the tank. When the construction machine needs to be finely or precisely operated, the operator chooses a fine operation mode as the rotation mode of the engine. Alternately, when the operator wants to perform general work using the construction machine, the operator chooses a standard operation mode as the rotation mode of the engine. Finally, when the operator wants to perform heavy work consuming a large driving force, the operator chooses a heavy operation mode as the rotation mode of the engine.

U.S. Pat. No. 5,469,646 issued to Fujitoshi Takamura on Nov. 28, 1995, discloses a conventional fine operation mode changeover device for a hydraulic excavator. During the operation of the hydraulic excavator in the fine mode, rotational speed of the engine is set to a relatively low speed and the angle of a wobble plate is decreased. Accordingly, the engine of the hydraulic excavator is driven at a relatively low RPM count, such as about 1,500 RPM. Consequently, a discharge flow rate of the pump decreases, and thereby the operator of the heavy excavator can precisely operate the heavy excavator.

However, in these conventional construction machines, such as the above hydraulic excavator, when the operator operates the boom cylinder without operating the arm cylinder in the fine operation mode, a second hydraulic fluid supplied from the second hydraulic pump is merged with the first hydraulic fluid supplied from the first hydraulic pump. This merged hydraulic fluid is then supplied to the boom cylinder. Likewise, when the operator operates the arm cylinder without operating the boom cylinder in the fine operation mode, the first hydraulic fluid is merged with the second hydraulic fluid. Similarly, the merged hydraulic fluid is then supplied to the arm cylinder.

Accordingly, the merged hydraulic fluid supplied to the arm cylinder or the boom cylinder causes the flow rate of the hydraulic fluid being supplied to the arm cylinder or the boom cylinder to be increased. Since the operating speed of the arm cylinder or the boom cylinder is increased, it is difficult to perform a precise work. Furthermore, in conventional construction machines, such as the above hydraulic excavator, when the operator operates the construction machine in the fine operation mode, a relatively large load is applied to the construction machine. As a result, the operating capability deteriorates.

SUMMARY OF THE INVENTION

The present invention is adapted to solve the foregoing problems.

It is a first object of the present invention to provide an apparatus for improving the operating capability of a construction machine during a fine operation mode by preventing merged hydraulic fluid from being supplied to a hydraulic actuator and capable of increasing the pressure of the hydraulic fluid being supplied to the hydraulic actuator.

It is a second object of the present invention to provide a method for improving the operating capability of a construction machine during a fine operation mode by preventing merged hydraulic fluid from being supplied to a hydraulic actuator and capable of increasing the pressure of the hydraulic fluid being supplied to the hydraulic actuator.

In order to achieve the above first object, the present invention provides an apparatus for increasing the operating capability of a construction machine during a fine operation mode. The construction machine including an engine, a first pump and a second pump being driven by the engine, a first actuator being driven by the first pump and a second actuator being driven by the second pump. The apparatus comprising:

detecting means for detecting a RPM count of the engine in order to determine whether the engine is switched to the fine operation mode;

a first anti-confluence valve and a second anti-confluence valve for preventing a first hydraulic fluid supplied into the first actuator and a second hydraulic fluid supplied into the second actuator from merging together during operation of that either the first actuator or the second actuator in the fine operation mode;

an anti-confluence relay for turning the first anti-confluence valve and the second anti-confluence valve on/off; and a controller for turning the anti-confluence relay on/off in accordance with a signal generated by the detecting means.

Preferably, the apparatus further comprises valve means for intensifying a pressure of the first hydraulic fluid or a pressure of the second hydraulic fluid during operation of the engine at the fine operation mode, and a pressure-intensifying relay for turning the valve means on/off.

Further, in order to achieve the above second object, the present invention provides a method for improving the operating capability of a construction machine during a fine operation mode. The construction machine includes an engine, a first pump and a second pump being driven by the engine, a first actuator being driven by the first pump and a second actuator being driven by the second pump. The method comprising the steps of:

Sensing a RPM count of the engine to determine whether the engine is switched to the fine operation mode; and preventing a first hydraulic fluid supplied into the first actuator and a second hydraulic fluid supplied into the second actuator from merging during the time that either the first actuator or the second actuator operates in the fine operation mode.

Preferably, the method further comprises the steps of increasing a pressure of the first hydraulic fluid or a pressure of the second hydraulic fluid during operation of the engine at the fine operation mode.

As described above, in the apparatus and the method for improving the operating capability of the construction machine during the fine operation mode according to a preferred embodiment of the present invention, it is possible to prevent the merged hydraulic fluid from being supplied into the first actuator or the second actuator during operation of the construction machine at the fine operation mode, and thereby it is possible to perform an operation with increased power.

BRIEF DESCRIPTION OF THE DRAWINGS

The above object and other characteristics and advantages of the present invention will become more apparent by describing in detail a preferred embodiment thereof with reference to the attached drawings, in which.

DETAILED DESCRIPTION OF THE INVENTION

Hereinafter, a preferred embodiment of the present invention will be explained in more detail with reference to the accompanying drawings.

Figure 1:
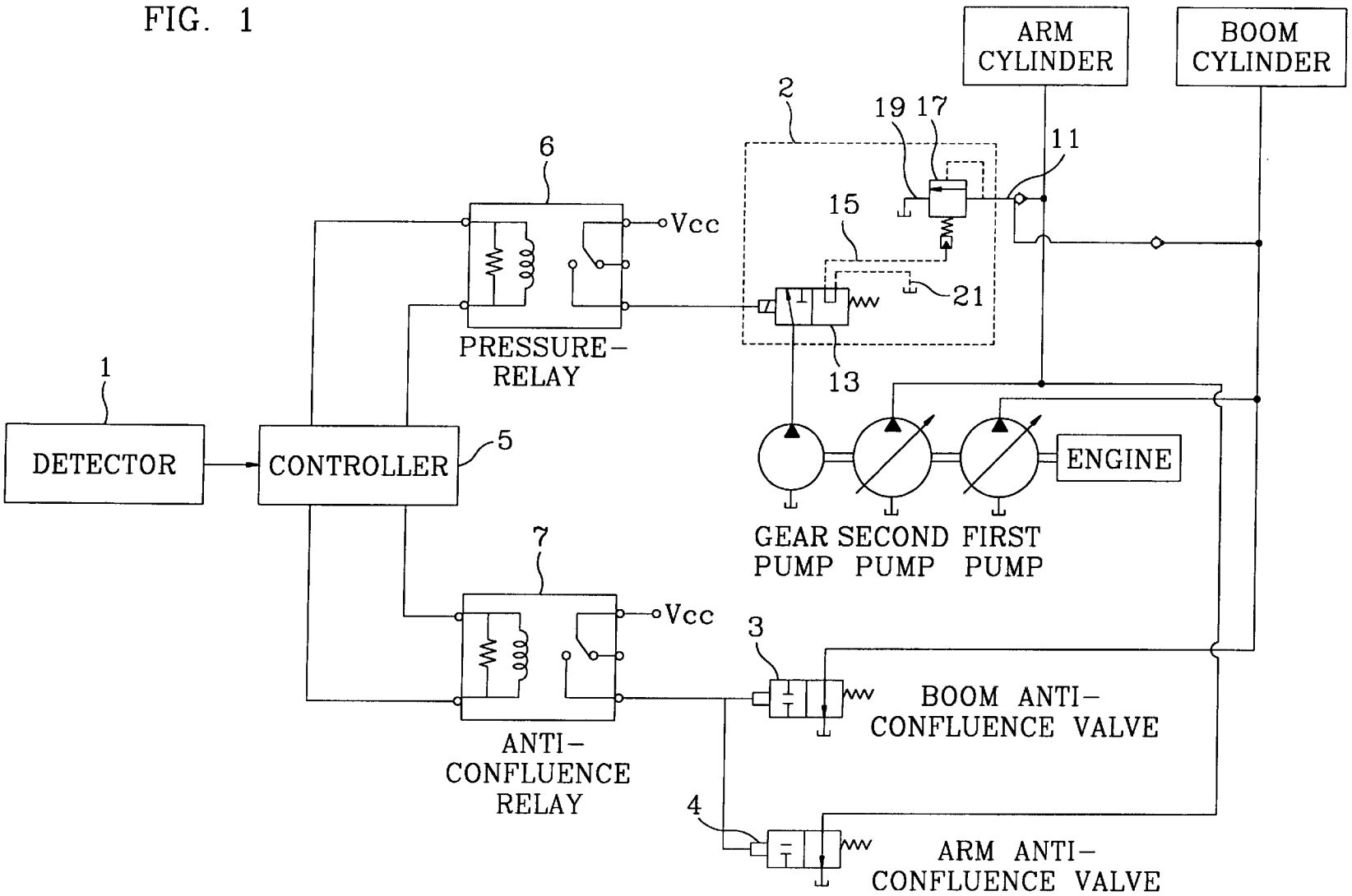
FIG. 1 is a schematic circuit diagram of an apparatus for improving an operating capability of a construction machine during a fine operation mode according to a preferred embodiment of the present invention.

FIG. 1 is a schematic circuit diagram of an apparatus for improving the operating capability of a construction machine during a fine operation mode according to a preferred embodiment of the present invention. Referring to FIG. 1, a detector 1 for detecting a RPM count of an engine (not shown) is connected with a controller 5. The detector 1 determines whether the engine is switched to a fine operation mode or not and generates a detecting signal. The controller 5 receives the detecting signal generated by the detector 1. Further, an anti-confluence relay 7 is connected with the controller 5. The anti-confluence relay 7 turns a boom anti-confluence valve 3 and an arm anti-confluence valve 4 on/off. In addition, a pressure-increasing relay 6 is connected with the controller 5. The pressure-increasing relay 6 turns a pressure-increase valve 2 on/off in order to increase the pressure of a hydraulic fluid being supplied into an arm cylinder or a boom cylinder during operation of the engine at a fine operation mode.

Figure 3:
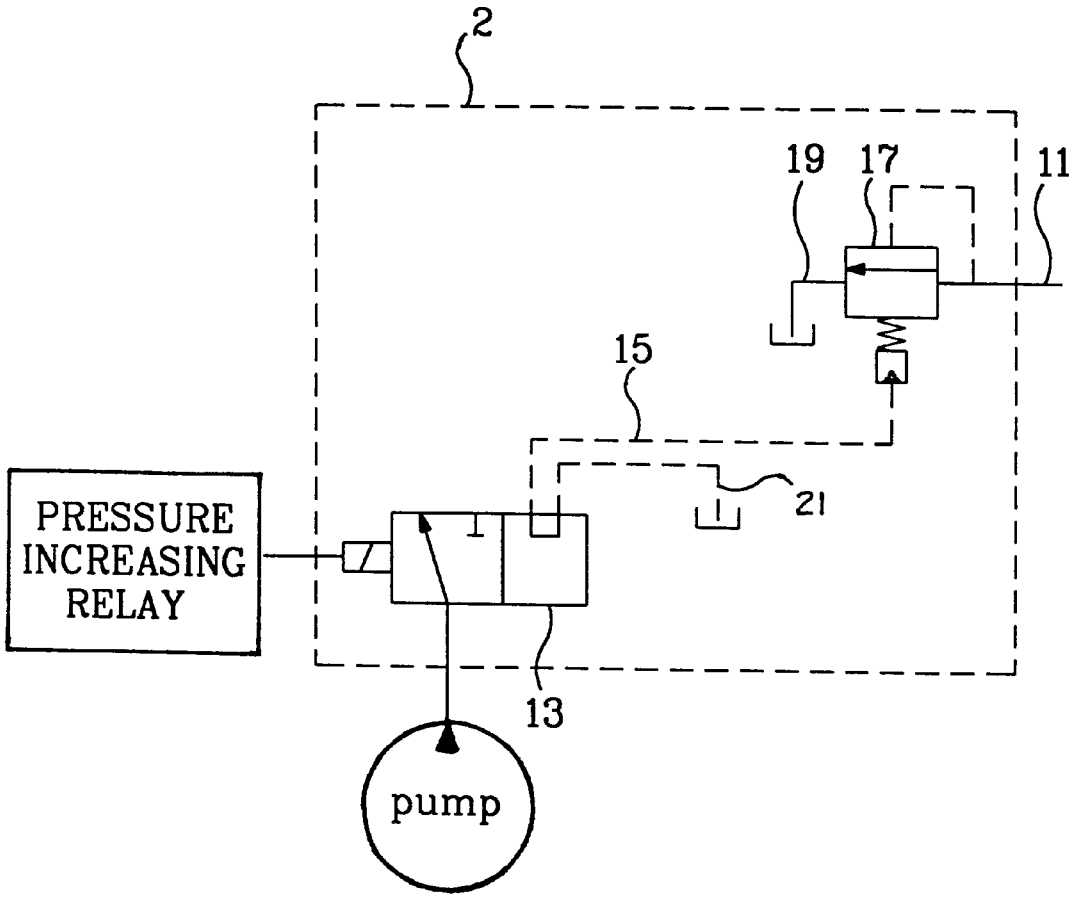
FIG. 3 is a schematic circuit diagram of the pressure-increasing valve.

As best seen in FIG. 3, the pressure-increasing valve 2 comprises a control valve 13 and a relief valve 17 connected to an oil passage 11. The pressure of oil passage 11 is increased by pressure-increasing valve 2. That is, when the control valve 13 receives a signal from the pressure-increasing relay 6, the control valve 13 shifts to the right side relative to FIG. 3, thereby allowing pressurized oil discharged from a pump to flow to a pilot line 15, which is connected to relief valve 17. When the pressurized oil contained in the pilot line 15 exerts pressure on the relief valve 17, the relief pressure of the relief valve 17 is increased. Consequently, the pressure within passage 11 is increased. When the signal from the pressure-increasing relay 6 is not transmitted to the control valve 13, the control valve returns to the left side and the oil within the pilot line 15 returns to the tank via a return passage 21 through control valve 13.

Figure 2:
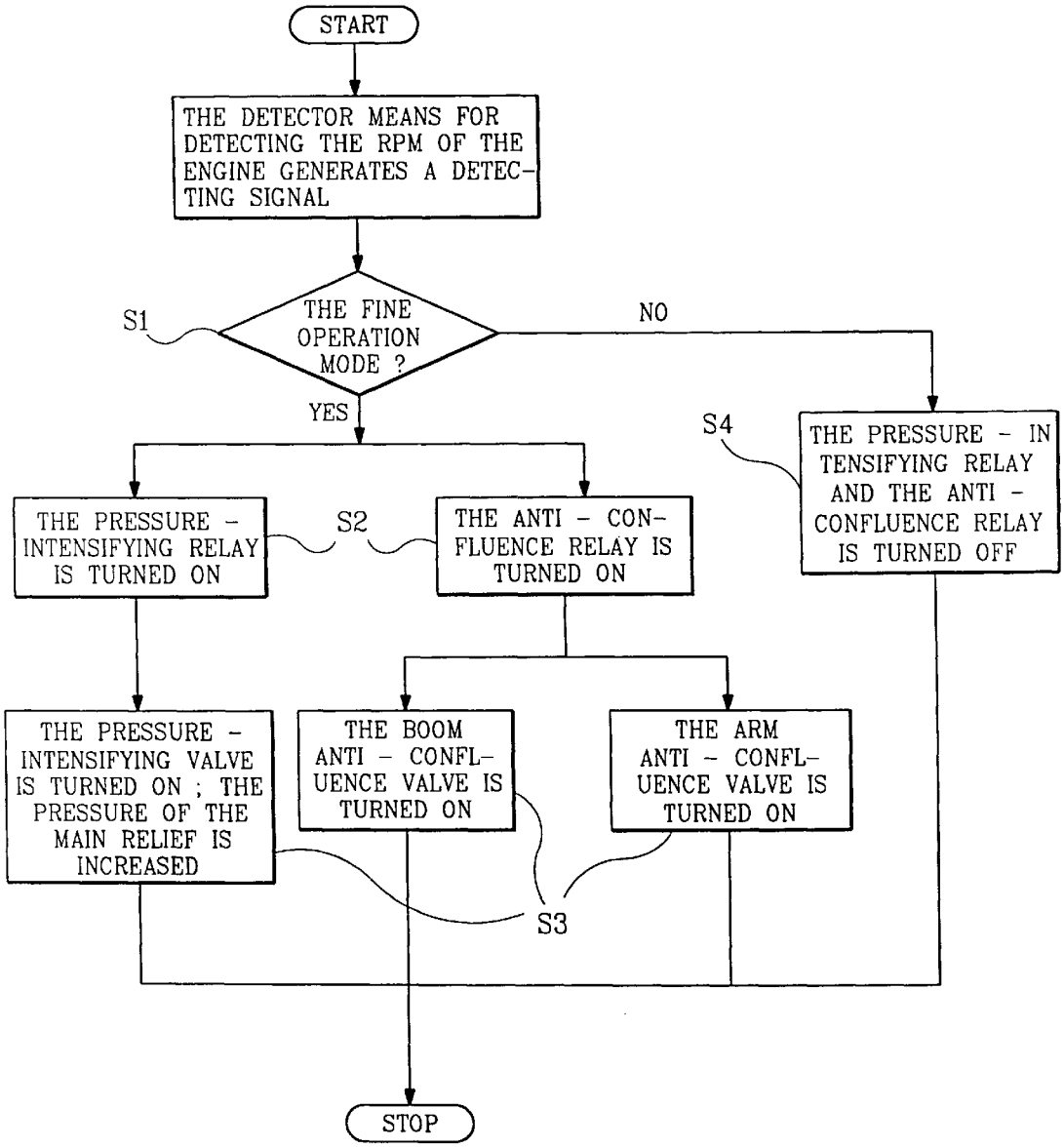
FIG. 2 is a flow chart illustrating a method for improving an operating capability of a construction machine during a fine operation mode according to the preferred embodiment of the present invention.

FIG. 2 is a flow chart illustrating a method for improving the operating capability of a construction machine during a fine operation mode according to the preferred embodiment of the present invention. Herein below, the method for improving the operating capability of the construction machine during the fine operation mode will be briefly explained.

Referring to FIG. 2, in step (S1), the detector 1 detects the RPM count of the engine (not shown) and determines whether the engine is switched to a fine operation mode or not and generates a detecting signal. The controller 5 receives the detecting signal generated by the detector 1. If the engine operates at the fine operation mode, the controller 5 turns the anti-confluence relay and the pressure-intensifying relay on (in steps (S2)).

On the one hand, when the anti-confluence relay 3 is turned on, the anti-confluence relay 3 turns the boom anti-confluence valve and the arm anti-confluence valve 4 on. As a result, it is possible to prevent the merged hydraulic fluid from being supplied into the boom cylinder or the arm cylinder. Therefore, it is possible to perform a precise work. On the other hand, when the pressure-intensifying relay 6 is turned on, the pressure-intensifying relay 6 turns the pressure-intensifying valve on. As a result, the main relief pressure of the construction machine is increased. Consequently, although a relatively large load is applied to the working device, such as the arm cylinder or the boom cylinder, it is possible to effectively perform a desired work (in steps (S3)).

Alternately, if the engine is not switched to the fine operation mode, the controller 5 turns the anti-confluence relay and the pressure-intensifying relay off (in steps (S4)).

As described above, in the apparatus and the method for improving the operating capability of the construction machine during the fine operation mode according to the preferred embodiment of the present invention, it is possible to prevent the merged hydraulic fluid from being supplied into the boom cylinder or the arm cylinder during operation of the construction machine at the fine operation mode, and thereby it is possible to perform a precise work.

Further, although a relatively large load is applied to the working device during the fine operation mode, it is possible to improve the operating capability of the construction machine by supplying a large driving force to the working device.

While the present invention has been particularly shown and described with reference to a particular embodiment thereof, it will be understood by those skilled in the art that various changes in form and details may be effected therein without departing from the spirit and scope of the invention as defined by the appended claims.

What is claimed is:

1. An apparatus for improving an operating capability of a construction machine during a fine operation mode including an engine, a first pump and a second pump being driven by the engine, a first actuator being driven by the first pump and a second actuator being driven by the second pump, the apparatus comprising:

detecting means for detecting a RPM count of an engine of the construction machine in order to determine whether said engine is switched to the fine operation mode;

a first anti-confluence valve and a second anti-confluence valve for preventing a first hydraulic fluid supplied into a first actuator and a second hydraulic fluid supplied into a second actuator from merging together during operation of either said first actuator or said second actuator in the fine operation mode;

an anti-confluence relay for turning said first anti-confluence valve and said second anti-confluence valve on/off; and a controller for turning said anti-confluence relay on/off in accordance with a signal generated by said detecting means.

2. The apparatus according to claim 1, further comprising:

valve means for intensifying a pressure of said first hydraulic fluid or a pressure of said second hydraulic fluid during operation of the engine in the fine operation mode; and a pressure-intensifying relay for turning said valve means on/off, said pressure-intensifying relay being connected to said valve means and said controller.

3. A method for improving an operating capability of a construction machine during a fine operation mode, the construction machine includes an engine, a first pump and a second pump being driven by the engine, a first actuator being driven by the first pump and a second actuator being driven by the second pump, the method comprising the steps of:

sensing a RPM count of the engine to determine whether the engine is switched to the fine operation mode; and preventing a first hydraulic fluid supplied into the first actuator and a second hydraulic fluid supplied into the second actuator from merging during the time that either the first actuator or the second actuator operates in the fine operation mode.

4. The method according to claim 3, further comprising the steps of:

increasing a pressure of said first hydraulic fluid or a pressure of said second hydraulic fluid during operation of the engine at the fine operation mode.

* * * * *